US005401190A

United States Patent [19]

Gandhi et al.

[11] Patent Number: 5,401,190

[45] Date of Patent: Mar. 28, 1995

[54] TELESCOPING-ROTATING (370) LAMP BASE

[75] Inventors: Harish F. Gandhi, Morgentown, W. Va.; Robert E. Cassidy, Lebanon, N.H.

[73] Assignee: Philips Electronics North America Corporation, New York, N.Y.

[21] Appl. No.: 990,314

[22] Filed: Dec. 14, 1992

[51] Int. Cl.[6] ..... H01R 17/00

[52] U.S. Cl. ..... 439/614; 439/613

[58] Field of Search ..... 439/11, 13, 611, 613, 439/614, 615, 229, 234, 266

[56] References Cited

U.S. PATENT DOCUMENTS

| | | | |
|---|---|---|---|
| 2,165,987 | 7/1939 | Sobczak et al. | 439/11 |
| 2,519,328 | 8/1950 | Whitmore et al. | 439/614 |
| 2,701,868 | 2/1955 | Pate et al. | 439/614 |
| 3,422,393 | 1/1969 | Plagge | 439/613 |
| 4,624,513 | 11/1986 | Haraden | 439/11 |
| 4,660,906 | 4/1987 | Haraden | 439/11 |
| 5,113,044 | 5/1992 | Tomberlin | 439/614 |

*Primary Examiner*—Larry L. Schwartz
*Assistant Examiner*—Hien D. Vu
*Attorney, Agent, or Firm*—Paul R. Miller

[57] ABSTRACT

A rotating-telescoping base structure for lamps or light bulbs is described. The structure may be rotated up to 320° and may be telescoped outwardly from the base structure. This enables use in applications where a longer neck dimension is needed or alignment of the fixture without unscrewing it from a socket is to be carried out.

4 Claims, 2 Drawing Sheets

TELESCOPING-ROTATING (370) LAMP BASE

The present invention involves an improved base design for lamps of the screw type or Edison design. In particular, the Edison base design of the present invention allows rotation of the light bulb up to 370° after being tightly screwed into a fixture. Moreover, this constriction can be easily telescoped or extended outwardly.

BACKGROUND OF THE INVENTION

Rotatable electric lamps have been in use for some time, such as seen in U.S. Pat. No. 2,165,987, but the amount of rotation is restricted to 360°. Other such prior structures may be seen relative to U.S. Pat. No. 4,660,906 and U.S. Pat. No. 4,654,557 also permitting a limited rotation of the lamp, ie. up to 180°. Application of screw type bases to fluorescent type lamps may be seen in U.S. Pat. No. 4,841,193 wherein a limited rotation of 140° is provided after screwing the lamp into a socket.

While these prior references show rotation of the lamp, such movement is limited relative to the amount of rotational control of the light from the lamp. Moreover, the ability to adjust the light outwardly from the base structure has never before been found.

SUMMARY OF THE INVENTION

The present invention, on the other hand, enables a complete control of the lamp structure to improve light output. In this respect, the present invention allows rotation of the lamp within the fixture of up to 370°. Moreover, the present invention enables the telescoping or extension of the lamp from the base structure to again control the amount and direction of the output light.

In particular, the structure of the telescoping and rotating base design of the present invention is applicable for use in single, two way or three way lighting operations. This can be applied to both incandescent type lighting, as well as fluorescent type lighting.

The present invention enables the alignment within a lighting fixture of a light bulb having the features of the present invention. The screw-type, or Edison-type, base light bulb can be screwed securely into the socket, and then, rotated for up to 370° without unscrewing the light bulb. This provides alignment of the lighting structure within the fixture.

Further, this structure then has the ability to telescope or extend the light bulb outwardly from the screw-type base. By this means, the lighting structure may be used in different applications, such as those that need a longer neck dimension for specific purposes. For example, such lights can be used in table lamps where the light can be extended for different purposes.

The structures provided by the present invention enable lighting base fixtures that may be used in either incandescent type lamps or compact lamps of the fluorescent type.

BRIEF DESCRIPTION OF THE DRAWING FIGURES

The present invention will now be more fully described relative to the drawing figures in which.

DESCRIPTION OF THE INVENTION

Figure 1:
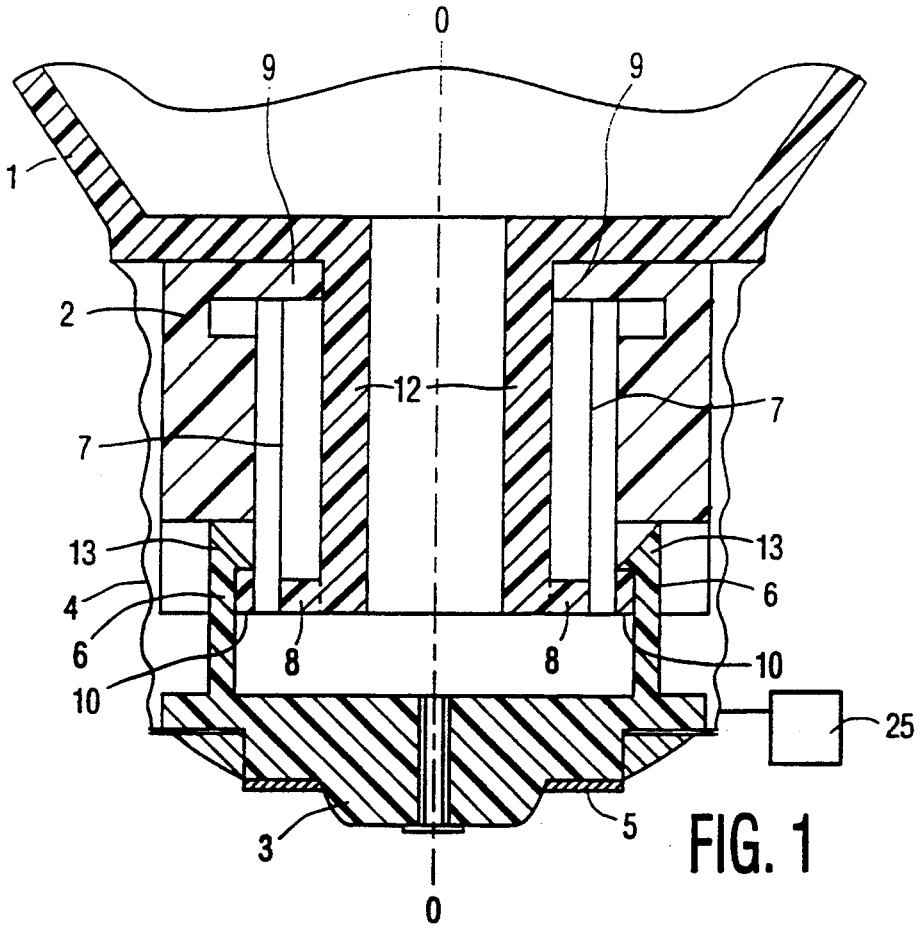
FIG. 1 shows a cross-sectional view of the base structure according to the present invention.
Figure 3:
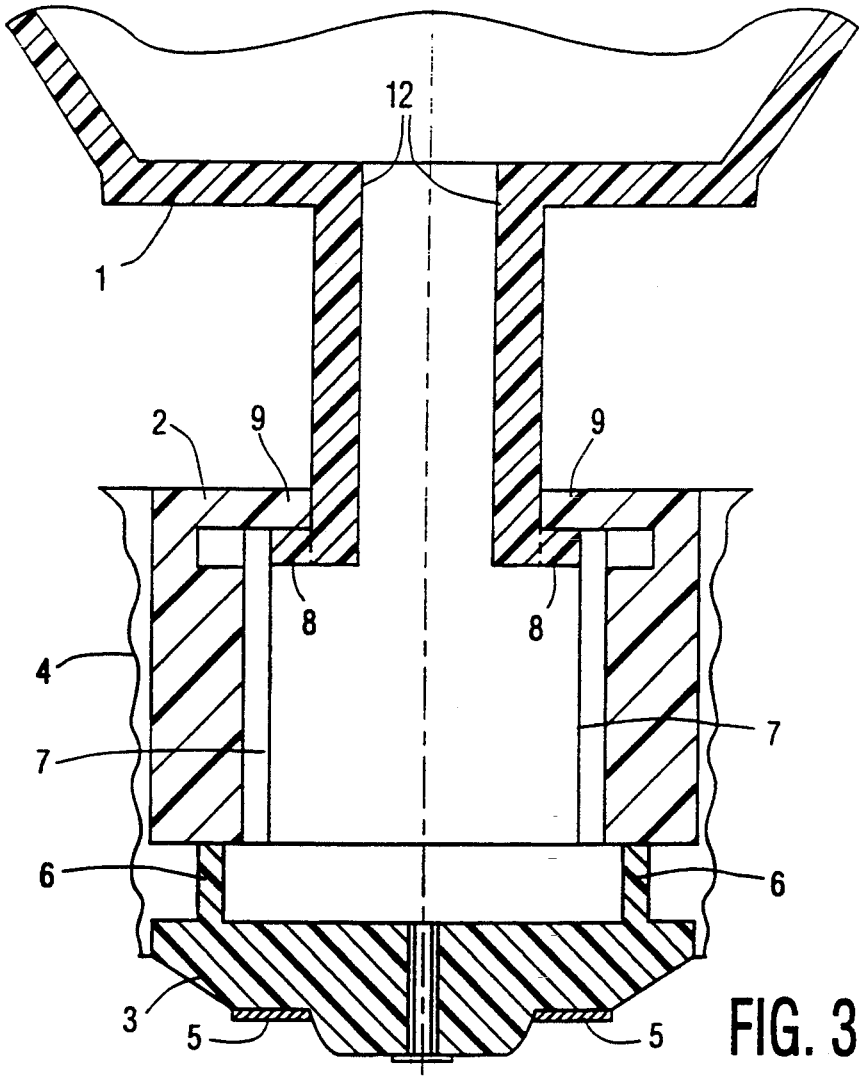
FIG. 3 is a telescoped version of FIG. 1.
Figure 4:
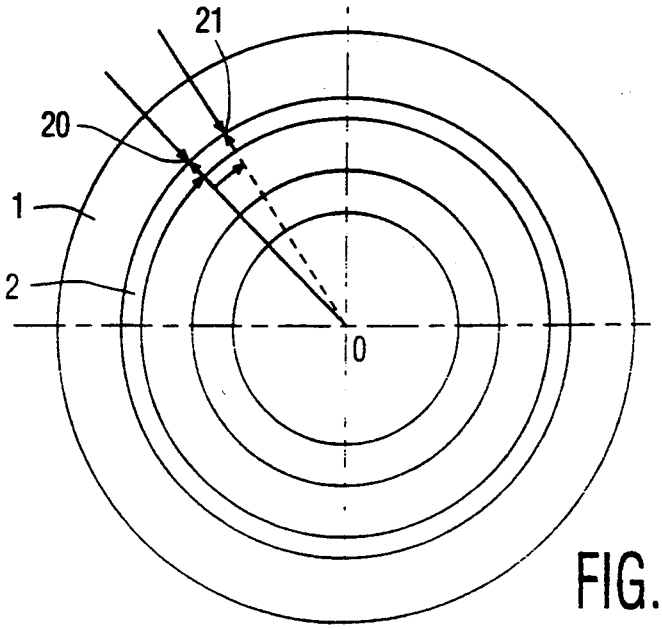
FIG. 4 is a schematic illustration of the amount of rotation of the structure of the present invention.

A schematic illustration of a screw-type lighting fixture is seen in FIG. 1 in which the base construction enables rotation of the light, as may be seen in FIG. 4, and extension outwardly of the light from the base, as may be seen in FIG. 3. The structure of FIG. 1 and FIG. 3 include a shell-type structure 1 which is used to enclose the electric lamp (not shown for clarity). This shell 1 of the light structure includes a cylindrical part 12 extending downwardly into the base and ending with two feet 8 at respective opposite sides of the cylindrical part 12.

Figure 2:
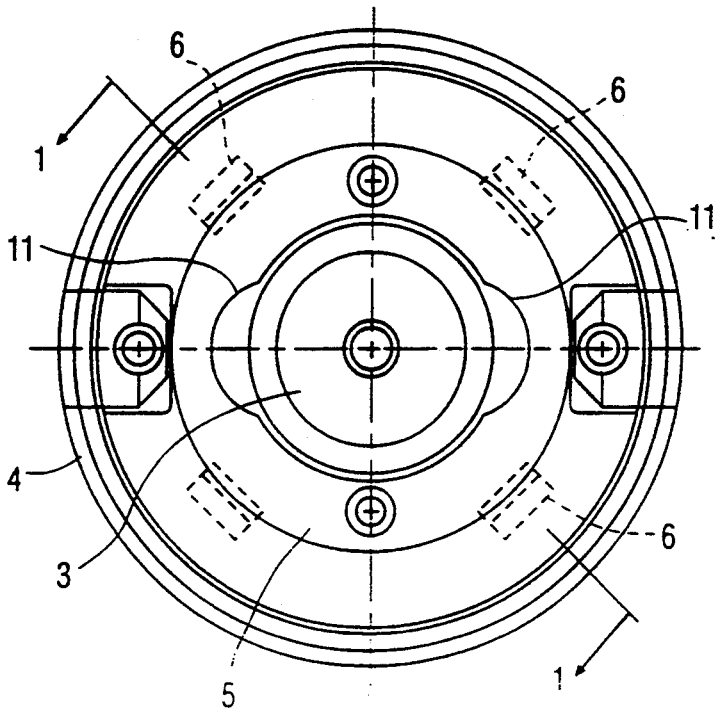
FIG. 2 shows a cross-sectional view of the bottom of FIG. 1 which is oriented along the line A—A.

The shell-like structure 1 with the cylindrical part 12 both rotates and extends outwardly, as may be seen in FIGS. 3 and 4, both actions occurring within a split collar member 2 of the base structure 4. This split collar member 2 is cylindrical in form and has a central opening through which the cylindrical part 12 extends. Within this split collar member 2 exists an inner sleeve 7 (not fully shown for clarity) having oppositely disposed openings 11 (see FIG. 2) in which the feet 8 may be rotated to and moveable outwardly and inwardly. That is, upon relative rotation of the shell-type structure 1 within the split collar member 2 and the inner sleeve, a position is reached at which the feet 8 are within the openings 11. At that point, the shell-type structure 1 may be pulled outwardly, as seen in FIG. 3, until the feet 8 strike the upper cover 9 of the split collar member 2. This enables the telescoping of the shell-type structure 1 from the base structure 4 having screw threads which enable the fastening of the lamp structure into a light socket fixture 25, shown in box-like phantom in FIG. 1.

The screw threads of the base structure 4 extend from the upper surface 9 of the split collar member 2 tube downwardly to a base holder 3. The base holder 3 includes four legs 6 extending upwardly to triangular-shaped heads 13 which attach over a ridge 10 of the split collar member 2. This effectively holds the telescoping arrangement into the base structure 4.

By this means, the shell-type structure 1 can be held against the base structure 4 and rotated 370° around the axis 0—0 in FIG. 1. This rotation may be seen in FIG. 4 where at an initial position 20, the shell-type structure 1 and the split collar structure 2 are lined up. Relative rotation of the two occurs in such a manner that going clockwise, one is turned with respect to the other 360° plus an extra 10° to the point 21 as may be seen in FIG. 4. Accordingly, a rotation of 370° occurs in order to permit adjustment of the light. This rotation of 370° may also occur when the shell structure 1 is telescoped outwardly, as shown in FIG. 3. A metallic ring-type structure 5 is mounted on the base 3 to provide two-way or three-way electrical connection.

The shell-type structure, the split-collar member, the base holder and inner sleeve may be of any non-conductive material, such as a plastic. The threaded base structure 4 and the ring-type structure 5 at the bottom of the base structure 4 may be of metal components, such as brass, or any conductive metallic material.

What we claim:

1. A rotatable and telescoping lamp having a light emitting portion comprising a screw-type base and a shell-type structure enclosing the light emitting portion of the lamp, said shell-type structure being mounted to said screw-type base such that said shell-type structure can rotate up to 370° relative to said screw-type base, said shell-type structure including means to allow the shell-type structure to be telescoped outwardly from said screw-type base when said shell-type structure is in a predetermined position relative to the screw-type base.

2. A lamp according to claim 1 suitable for single, two-way or three-way lamp operation.

3. A lamp having a light emitting portion comprising a threaded screw-type base and a shell-type structure enclosing the light emitting portion, said shell-type structure being rotatable through 370° with respect to said screw-type base after said screw-type base is tightly screwed into a fixture, said lamp being suitable for single, two-way or three-way lamp operation, wherein said shell-type structure includes an insulator structure with a cylindrical hollow tongue, and wherein said screw-type base includes a split collar member having an inner sleeve member having a cylindrical opening in which said tongue moves outwardly and inwardly therein to allow said shell-type structure to telescope from said screw-type base when said shell-type structure is in a predetermined position relative to the screw-type base.

4. A lamp having a light emitting portion comprising a threaded screw-type base and a shell-type structure enclosing the light emitting portion, said shell-type structure being rotatable through 370° with respect to said screw-type base after said screw-type base is tightly screwed into a fixture, wherein said shell-type structure includes an insulator structure with a cylindrical hollow tongue, and wherein said screw-type base includes a split-collar member having an inner sleeve member and further having a cylindrical opening in which said tongue moves outwardly and inwardly therein to allow said shell-type structure to telescope from said screw-type base when said shell-type structure is in a predetermined position relative to the screw-type base.

* * * * *

UNITED STATES PATENT AND TRADEMARK OFFICE

CERTIFICATE OF CORRECTION

PATENT NO. : 5,401,190
DATED : March 28, 1995
INVENTOR(S) : Harish F. Gandhi, et al.

It is certified that error appears in the above-indentified patent and that said Letters Patent is hereby corrected as shown below:

IN THE ABSTRACT line 3, change 320° to --370°--.

Signed and Sealed this

Twenty-third Day of January, 1996

*Attest:*

Bruce Lehman

BRUCE LEHMAN

*Attesting Officer*

*Commissioner of Patents and Trademarks*